United States Patent [19]

Stenemann et al.

[11] Patent Number: 5,059,061

[45] Date of Patent: Oct. 22, 1991

[54] TRUCK MOUNTED PAVEMENT MARKING APPLICATOR

[75] Inventors: Heinrich F. Stenemann; Louis F. Keller, both of St. Paul, Minn.

[73] Assignee: Minnesota Mining and Manufacturing Company, Saint Paul, Minn.

[21] Appl. No.: 538,384

[22] Filed: Jun. 14, 1990

[51] Int. Cl.[5] ..... E01C 23/16

[52] U.S. Cl. ..... 404/72; 404/94

[58] Field of Search ..... 404/94, 95, 93, 82, 404/79, 14, 72

[56] References Cited

U.S. PATENT DOCUMENTS

| | | | |
|---|---|---|---|
| 3,007,838 | 11/1961 | Eigenmann | 156/526 |
| 3,155,564 | 11/1964 | Eigenmann | 156/575 |
| 3,235,436 | 2/1966 | Eigenmann | 156/523 |
| 3,350,256 | 3/1964 | Eckman et al. | 156/497 |
| 3,477,352 | 11/1969 | Harding et al. | 404/14 X |
| 3,844,669 | 10/1974 | Eigenmann | 404/94 |
| 3,964,559 | 6/1976 | Eigenmann | 180/313 |
| 4,030,958 | 6/1977 | Stenemann | 404/94 X |
| 4,071,384 | 1/1978 | Eigenmann | 404/94 X |
| 4,162,862 | 7/1979 | Harker et al. | 404/72 |
| 4,236,950 | 12/1980 | Eigenmann | 404/94 X |
| 4,242,173 | 12/1980 | Stenemann | 404/94 X |
| 4,317,696 | 3/1982 | Hutchinson et al. | 404/94 X |
| 4,373,670 | 2/1983 | Kilner | 404/93 X |
| 4,376,077 | 3/1983 | Eigenmann | 404/93 X |
| 4,565,467 | 1/1986 | Eigenmann | 404/72 |
| 4,623,280 | 11/1986 | Stenemann | 404/94 |

*Primary Examiner*—Hoang C. Dang

*Attorney, Agent, or Firm*—Gary L. Griswold; Walter N. Kirn; Douglas B. Little

[57] ABSTRACT

Method and apparatus are disclosed for automatically applying pavement marking tape to roadway surfaces using a self-propelled vehicle. Tapes can be applied in continuous stripes or intermittent stripes of variable spacing or length while the vehicle is in motion. Methods are also disclosed for changing rolls of tapes while the vehicle is in motion, and thereby reducing stopping times for splicing. The tape application mechanism can be enclosed within the vehicle so that the operator is protected from traffic hazards.

12 Claims, 9 Drawing Sheets

TRUCK MOUNTED PAVEMENT MARKING APPLICATOR

BACKGROUND OF THE INVENTION

In comparison with painted road markings, pavement-marking tapes generally offer superior reflectivity, visibility and durability on streets and highways. However, despite superior performance, pavement-marking tapes are not always selected for pavement marking in place of paint.

Independent of differences of material costs between road marking tape and paints, one explanation for not selecting tape is the current lack of suitably efficient equipment for application of large amounts of tape to roadway surfaces during a short span of time. Existing application systems are exemplified by the manual systems taught by Eckman in U.S. Pat. No. 3,350,256, and the semi-automated systems taught by Eigenmann in U.S. Pat. Nos. 3,007,838; 3,155,564; 3,235,436 and 4,565,467. The systems taught by Eigenmann are adapted to cut tape into strips and subsequently apply the tape strips to the roadway surfaces.

The present inventor previously developed a pavement-striping apparatus, disclosed in U.S. Pat. No. 4,030,958 and incorporated herein by reference. The previous apparatus is a trailer type unit. One drawback of a trailer unit is the relatively long time required to align and orient the unit for accurate applications of short lengths of tape. For this reason, a manual application apparatus has often been employed in such situations. The tape application process involving the trailer type apparatus also required a three person crew, one of the crew driving a tow vehicle and one of the crew driving a following vehicle. The third member of the crew typically rides in the tow vehicle and repeatedly returns to the trailer for loading of the apparatus. This necessitates stopping the apparatus to install fresh rolls of tape and splice the tape after application of each roll of pavement marking tape is dispensed.

Another problem encountered with tape applicator devices currently in use is the difficulty in obtaining stability of bond between the tape and the roadway. Although rollers have been employed to further urge the tape against the roadway, the industry has generally relied upon vehicle tires as part of the application process. However, until a stable bond has been achieved, vehicles which stop, start or turn abruptly upon the newly applied tape may dislodge or distort the tape. The usual solution to this problem has been furnishing a following vehicle to drive upon the tape. The following driver (i.e. the second crew member) is instructed to diligently drive the left front wheel of the following vehicle over the tape and to avoid abrupt maneuvers on the tape. In practice, the following driver may fail to accomplish the assigned task, necessitating subsequent costly replacement of poorly secured portions of tape after a very brief service life.

An application apparatus which eliminated the necessity for reliance upon a following vehicle with a diligent, experience crew member to achieve a stable installation and/or allowed for a more rapid overall application rate would be very desirable.

SUMMARY OF THE INVENTION

The present invention includes an apparatus for applying pavement-marking tape to a roadway surface. The apparatus includes a self-propelled, steerable vehicle having a rear wheel and a device attached to the vehicle. The attached device includes a plurality of feed mandrels for rotatably supporting rolls of tape and dispensing tape from the rolls; a mechanism for accumulating a variable length of tape dispensed from one of the mandrels; and a tape deposition mechanism (application head) situated on or adjacent to the roadway surface preceding the rear wheel of the vehicle. The device is preferably mounted inside a truck.

In addition, the present invention includes a method for continuously applying pavement-marking tapes to a roadway surface. The method includes the steps of providing an application device on a forward moving self-propelled vehicle, the device having a tape deposition head situated adjacent a portion of the roadway surface preceding the rear wheel of the vehicle; depositing tape upon the roadway surface and tamping the deposited tape with the rear wheel of the vehicle. The method preferably includes the additional steps of mounting a roll of tape on a mandrel of the device, threading the tape from the roll through an accumulation mechanism and through an application head having a nip, and depositing the tape through the nip to the roadway surface. Forward motion of the vehicle results in the rear wheel traveling over the tape and tamping the tape to the roadway to secure and complete the application. Preferably, the device includes a second mandrel from which a second tape roll may be mounted. The preferred method requires only a momentary delay of the vehicle for splicing a second tape to the first tape, since the second tape roll may be mounted and prepared for splicing during the application of the first roll of tape.

The apparatus and method of the present invention also allows a two person crew to apply the pavement marking tape since the necessity of a following vehicle and a diligent driver for the following vehicle has been eliminated. The apparatus and method of the present invention are suitable for application of tapes on tight radius turns, and the apparatus is more maneuverable than existing trailer type systems.

DETAILED DESCRIPTION OF THE PREFERRED EMBODIMENTS

Figure 1:
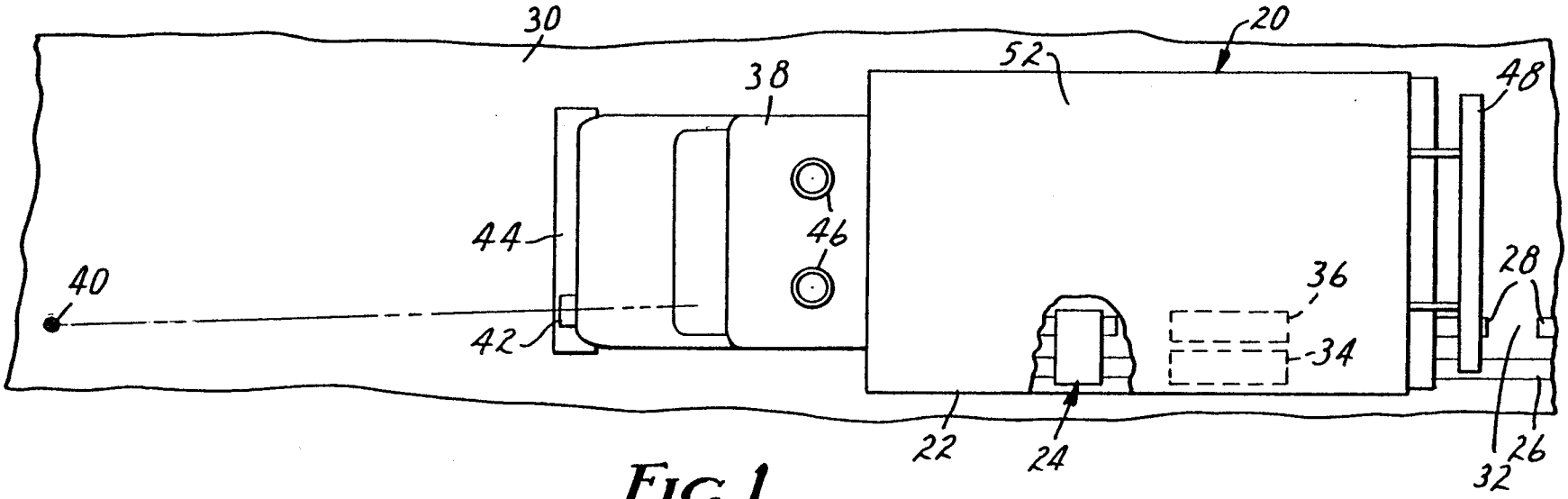
FIG. 1 is a top view of a preferred embodiment of the present invention with portions cut-away and portions shown in dotted outline.

A preferred embodiment of the apparatus of the present invention is shown in FIG. 1 at 20. The apparatus 20 includes a self-propelled steerable vehicle 22. The apparatus 20 also includes a device 24 carried by the vehicle 22. Together, the vehicle 22 and device 24 form an apparatus 20 which is relatively easy to maneuver and is useful to apply pavement marking tapes 74 and 117 to a roadway surface 30. The tapes 74 and 117 may be applied as a continuous stripe 26 or as discontinuous stripe segments 28 each segment being separated from the next segment by an untaped portion 32 on the roadway surface 30.

Preferably, the vehicle 22 is a truck having dual rear wheels and appropriately reinforced springs to handle the weight of the device 24, a load of rolls of tape, and a two person operating team (i.e. a vehicle driver and a device operator). In FIG. 1, outside dual left rear wheel 34 and inside left dual rear wheel 36 are shown in dotted outline. The tapes 26 and 28 on the roadway 30 are applied along the path to be traveled by dual rear wheels 34 and 36. A driver or operator steering the vehicle 22 from within cab 38 may efficiently predict the path to be followed by rear dual wheels 34 and 36 by sighting through a guidance device 42 mounted on the front bumper 44 of vehicle 22. Guidance device 42 includes a combination of a halfsilvered mirror and a lamp which appears to project an illuminated mark upon the roadway surface 30 at point 40. Point 40 is generally on the pathway to be followed by rear dual wheels 34 and 36. A preferred guidance device 42 is a model 2406 collimator sight available from the M-B Co., Inc. of Wisconsin.

Figure 2:
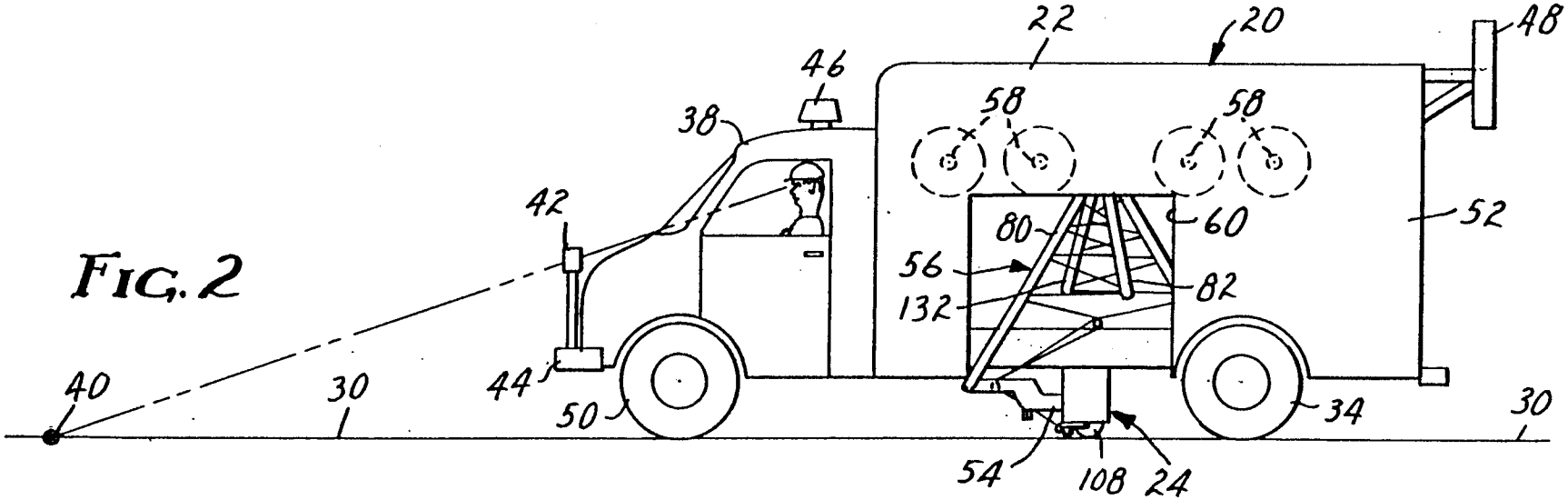
FIG. 2 is a side view of the apparatus.

As shown in FIG. 2, the vehicle 22 also preferably includes warning lights 46 mounted on top of cab 38 for warning oncoming traffic and a warning board 48 mounted at the rear of the vehicle 22 for warning overtaking traffic approaching from the rear. The vehicle 22 also includes steerable front wheels 50. The vehicle is driven forward along the roadway surface 30 by rear wheel 34, however, an alternative embodiment of an apparatus of the present invention could employ a front wheel drive vehicle. The device 24 is generally enclosed within the rear compartment 52 of the vehicle 22.

The device 24 includes a tape deposition mechanism 54. The tape deposition mechanism 54 is situated adjacent the roadway surface 30 in a position preceding the rear left dual wheel 34 and generally following the left front steerable wheel 50. Because the tape deposition mechanism precedes the rear wheels 34 and 36 on the same vehicle 22, the tapes 26 and 28 are virtually assured of achieving a secure bond to the roadway surface 30 through forward motion of the vehicle 22.

The device 24 further includes an accumulator mechanism 56 capable of accumulating variable lengths of tape for subsequent release to the deposition mechanism 54. The device 24 also includes a plurality of feed mandrels 58 shown in dotted outline which served to dispense tape from rolls of tape to the accumulator mechanism 56. The mandrels 58 are generally designated in FIG. 2, but later in this description will be referred to by individual numbers 72, 110, 114 and 116.

The tape deposition mechanism 54 may be raised for rapid travel of the vehicle 22 of the apparatus 20 at typical highway traffic speeds. The rear compartment 52 of the vehicle includes a large aperture 60 for accessing in maintenance of the device 24. The aperture 60 may be covered by a panel made of canvas, plastic or metal (not shown) to further protect the device 24 and any on board supplies of tape during high speed travel or exposure to inclement weather.

Figure 3:
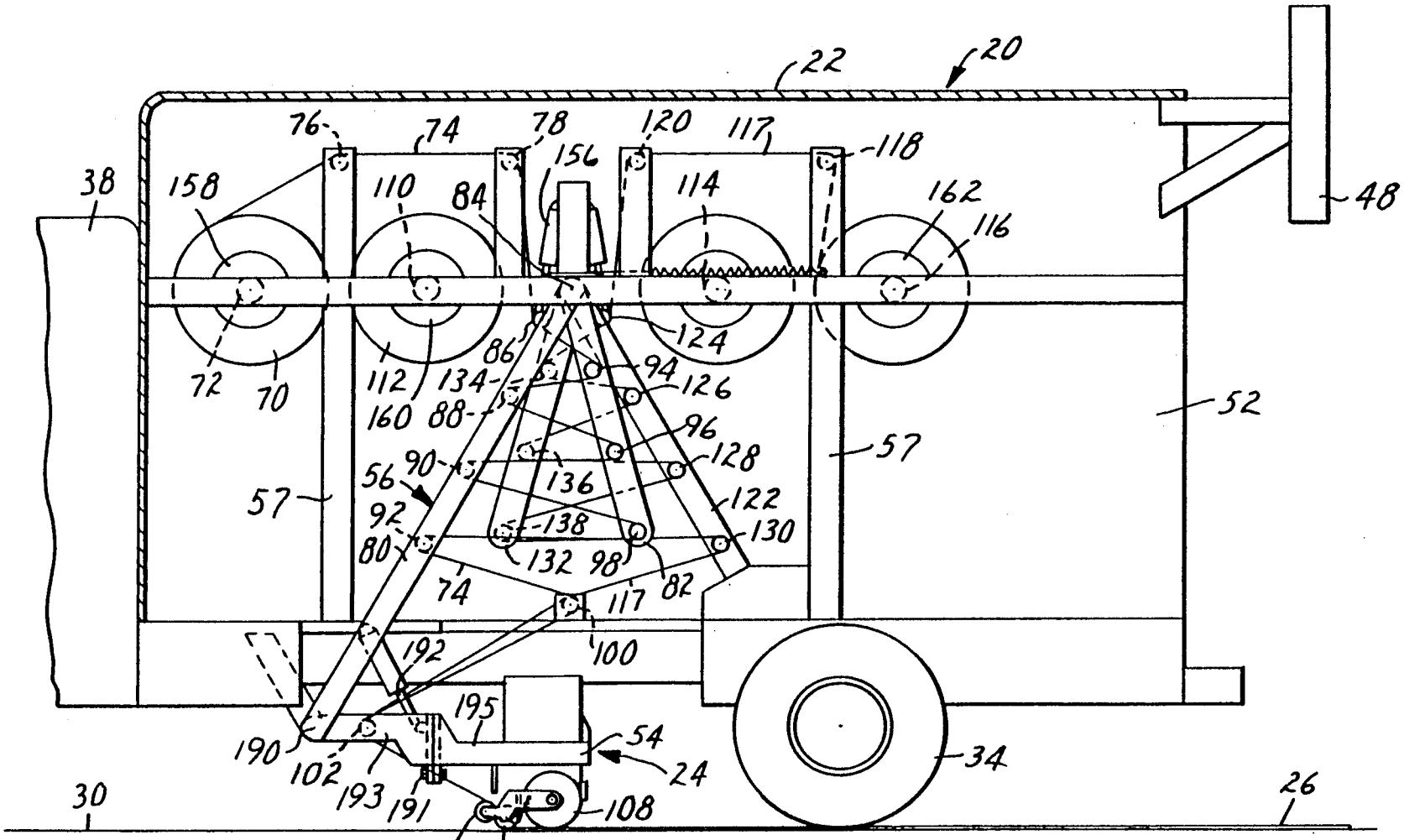
FIG. 3 s a partial side view with portions removed showing parts of the tape deposition mechanism and tape accumulating means.

As shown in FIG. 3, the device 24 includes a frame system 57 to carry the tape deposition mechanism 54, the accumulator mechanism 56 and the feed mandrels 58. The frame system 57 attaches to the vehicle 22 and facilitates removal of the device 24 from the vehicle 22 in order to free the vehicle 22 for alternative service uses. Optionally, the frame system 57 might be an integral and nonremovable part of the vehicle 22.

The device 24 is capable of applying two strips of tape 26 and 28 to the roadway surface 30. The system for a single tape, specifically the left tape 26, will be described first.

The left most tape strip 26 begins as a roll 70 rotatably supported upon a feed mandrel 72 of a plurality of mandrels 58. The web 74 from the roll 70 travels over a first idler roller 76 located generally above the plurality of feed mandrels 58, then forward to a second idler roller 78 located generally above the accumulator mechanism 56. From the second idler roller 78, the tape travels in a serpentine path, generally downward through the accumulator mechanism 56. The portion of the accumulator mechanism 56 responsible for the tape web 74 includes a stationary arm 80 and a pivotable arm 82. Pivotable arm 82 is rotatably supported at the upper end by a pivot axis 84 laterally supported by frame system 57. Pivotable arm 82 can swing forward and rearward about pivot axis 84 approximately 60° relative to stationary arm 80, which is also supported at the upper end by the pivot axis 84.

The stationary arm 80 carries four spaced apart accumulator rollers: an upper or first roller 86 (adjacent pivot axis 84), a second roller 88, a third roller 90, and a lower or fourth roller 92. Pivotable arm 82 carries three spaced apart accumulator rollers: an upper or first roller 94 (adjacent the pivot access 84), a middle or second roller 96, and lower or third roller 98 (adjacent to the lower end of the pivotable arm 82).

The tape web 74 is threaded through the accumulator mechanism 56 and progresses downward from the second idler roller 78 to the upper roller 86 of the stationary arm 80; thence to the upper accumulator roller 94 of the pivotable arm 82; thence to the second accumulator roller 88 of the stationary arm 80; thence to the middle accumulator roller 96 of pivotable arm 82; thence to the third accumulator roller 90 of the stationary arm 80; thence to the third and lowest accumulator arm 98 of the pivotable arm 82; thence to the lowest accumulator roller 92 of the stationary arm 80.

Figure 5:
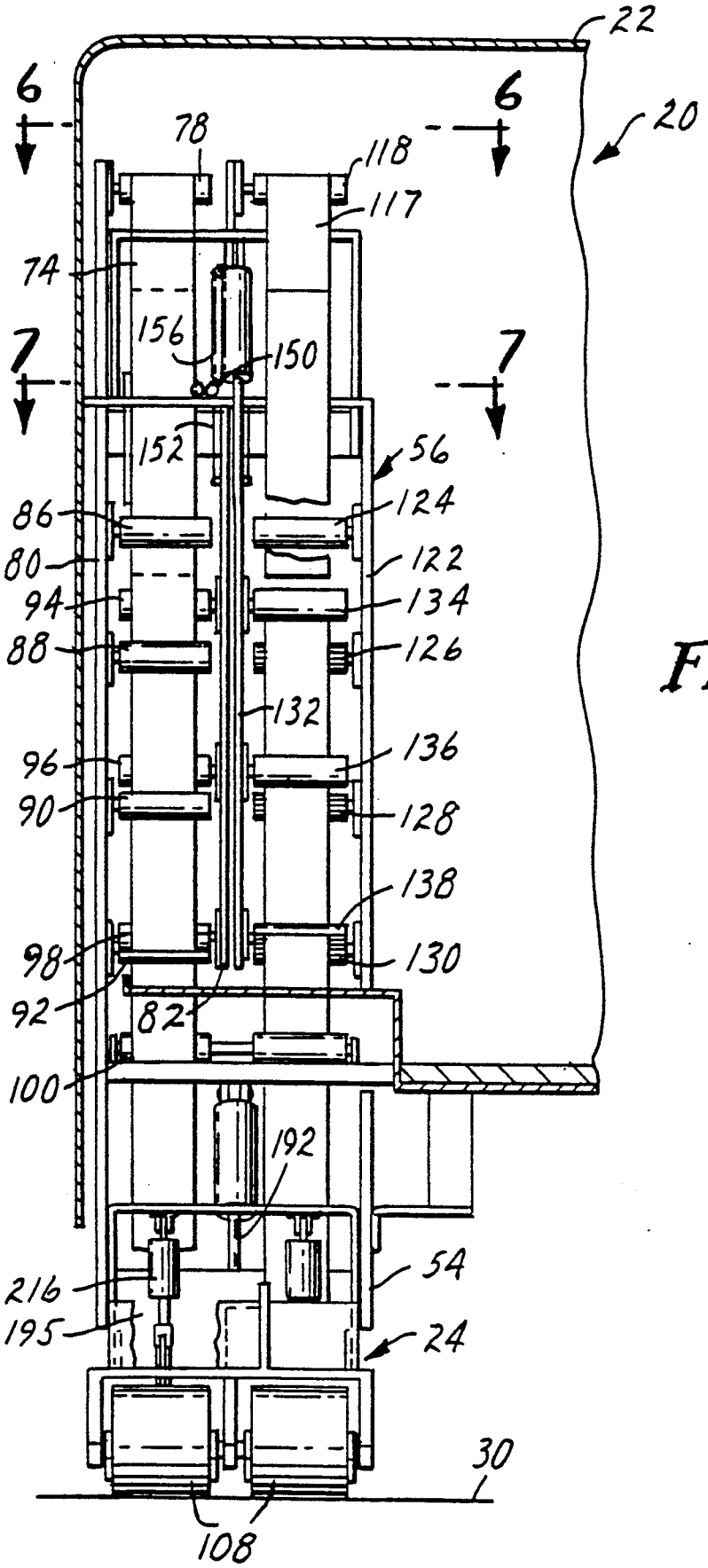
FIG. 5 is a sectional view at 5—5 of FIG. 4.

From the fourth accumulator roller 92 of the stationary arm 80 the tape web 74 travels over a third idle roller 100 attached to the floor of the rear compartment 52 (as shown in FIG. 5) at a position generally below the pivotable arm 82 for release to the deposition mechanism 54.

From the third idler roller 100, the tape web 74 precedes to a fourth idler roller 102 on the tape deposition mechanism 54. The tape 74 is then threaded over a keeper roller 104 and under an engagement roller 106. The engagement roller 106 forms a nip 107 with the roadway surface 30 and places the adhesive side of the tape 74 against the roadway surface 30. Next, the tape 74 travels under a preliminary pressure roller 108. Finally, the tape 74 goes under the left most dual rear wheel 34 which serves to firmly secure the tape 74 to the roadway surface 30 thus forming tape stripe 26.

A second mandrel 110 is mounted on the device 24 aligned with and immediately rearward of mandrel 72. The second mandrel 110 carries a spare roll of tape 112 which may also dispense tape over the first idler roller 76.

The device 24 of the preferred embodiment 20 also includes a second system for applying a right side tape stripe 28. The first (left side) system is essentially duplicated in the second (right side) system which is generally situated immediately to the right of the first system. The mandrels 114 and 116 of this second system can each carry a roll of tape and can, with substantially equal facility, dispense or feed tape 117 over a first idler roller 118, thence to a second idler roller 120 and into the accumulator system 56, and continue through to the tape deposition mechanism 54 for securing by the inner dual rear wheel 36 (previously shown in FIG. 1). The second accumulator mechanism also includes a stationary arm 122 carrying four spaced apart accumulator rollers: an upper or first roller 124, a second roller 126, a third roller 128, and a lower or fourth roller 130, and a second pivotable arm 132 having three accumulator rollers: an upper or first roller 134, a middle or second roller 136, and a lower or third roller 138. In the second system the tape threading and travel essentially duplicate the first system.

When the pivotable accumulator arm 82 or 132 of the accumulator 56 achieves the maximum angle of 60° relative to the stationary arm, 80 or 122 respectively, a serpentine path of maximum length, in one embodiment approximately 8 feet 5 inches (257 cm), is provided. Alternatively, when the pivotable accumulator arm 82 or 132 achieve an angle of 0° relative to the stationary accumulator arm, 80 or 122 respectively, a serpentine path of minimum length, in one embodiment approximately 30 inches (76 cm), is provided. The variation in path length provided by the accumulator mechanism 56 allows for temporary compensation of differences between tape deposition rates (i.e. deposition rates corresponding to the forward speed of the vehicle 22 along the roadway surface 30) and dispensing rates of tape 74 from a roll (such as roll 70 on a mandrel 72). Such a temporary differential occurs during two different functions of the device 24.

First, tape deposition is initiated while the vehicle 22 is already under forward motion at rates of from approximately 5 to approximately 10 miles per hour (8 to 16 kilometers per hour). It would be extremely difficult, if not impossible, to nearly instantaneously accelerate a roll 70 from nonrotation to a sufficient rate of rotation to match the ground speed. Without the accumulator mechanism 56, the initially deposited tape would either not engage the roadway surface 30 firmly, or alternatively, would snap somewhere in the web from the sudden excess tension. The accumulator mechanism 56 accommodates the initiation of tape deposition by rapidly reducing the serpentine path length, thereby rapidly releasing tape 74 and allowing the tape roll 70 to gradually begin to rotate and dispense tape 74.

Second, at the termination of tape deposition, the leading edge of the tape 74 must stop abruptly, whereas the rapidly spinning roll 70 tends to continue spinning and dispense excessive tape 74. The accumulator mechanism 56 accommodates the termination of tape deposition by rapidly increasing the serpentine path length, thereby rapidly accepting tape dispensed from the tape roll 70 and allowing the roll 70 to gradually stop.

Using two mandrels for each application system, an operator working within the rear compartment 52 can load and prepare one mandrel while the tape material is being dispensed from the other mandrel. Assuming an experienced operator, the ability to load and prepare the tape rolls for splicing while the vehicle 22 is in motion significantly reduces the delay of tape application between rolls from about 40 seconds (typical of existing systems) to less than about 5 seconds.

The accumulator mechanism 56 includes controlled biasing of the pivotable arms 82 and 132 to enable increasing or decreasing of the serpentine path length. As above, since the two tape systems are essential duplicates, the detailed operation need only be described for the outer most system.

Figure 4:
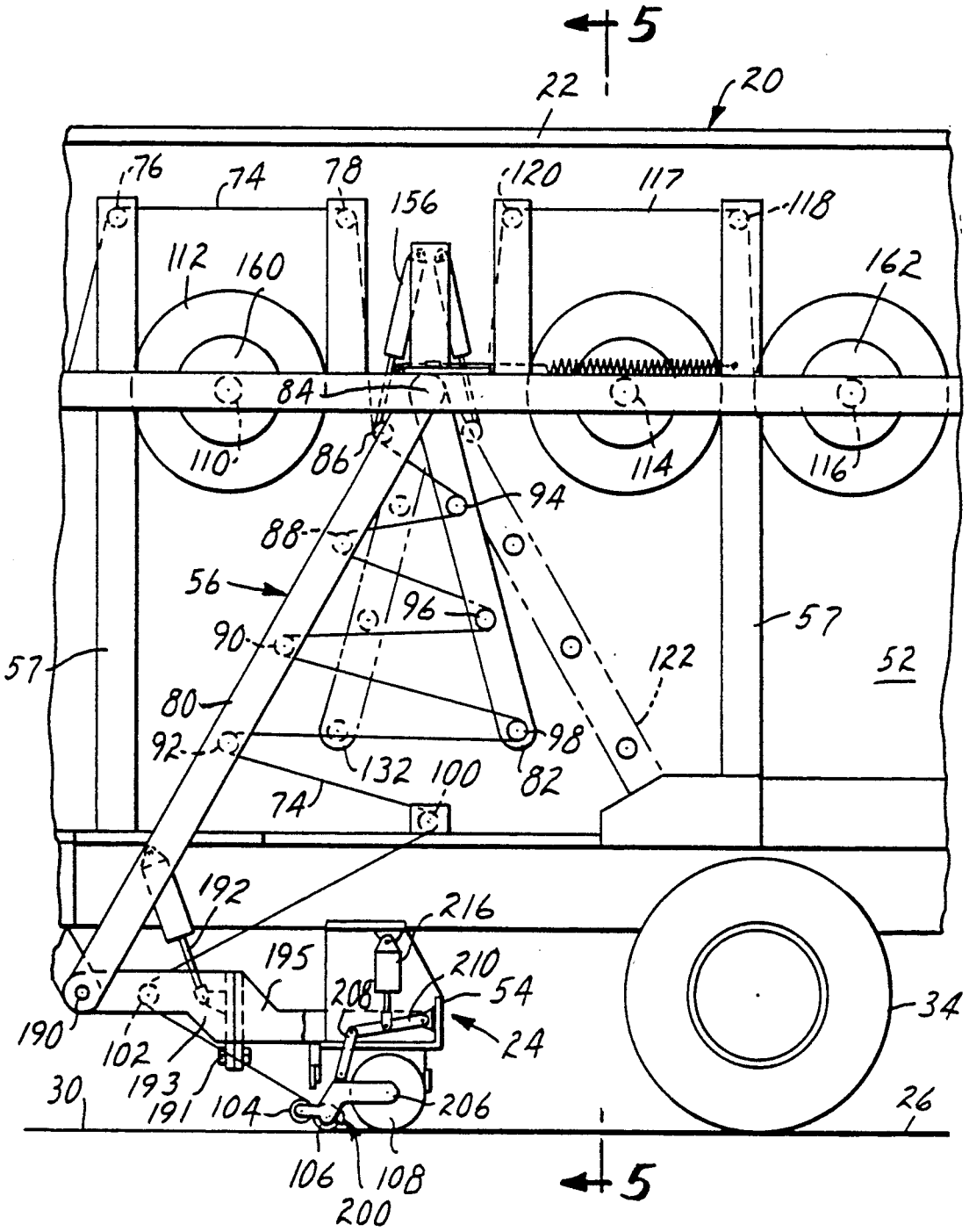
FIG. 4 is a more detailed side view with portions removed.

The pivotable arm 82, as shown in FIG. 4, is attached at its upper rear edge to a helical tension spring 150 through a cable 152 and a pulley 154. The tension spring 150 is attached at its opposite end to the frame system 57. Preferably, the spring 150 and cable 152 are adjustable in length and therefore in tension. The spring 150 and cable 152 bias and urge the pivotable arm 82 to its fullest angular position relative to the stationary arm 80. As explained earlier, this position corresponds to a maximum serpentine path length.

A double acting pneumatic piston 156 is also attached at a first end to the pivotable arm 82 and to the frame system 57 at a second end. Retraction of the piston 156 forces the pivotable arm 82 toward the stationary arm 80, thereby decreasing the serpentine path length. Extension of the piston 156 forces the pivotable arm 82 away from the stationary arm 80 and thereby increases the serpentine path length.

Figure 12:
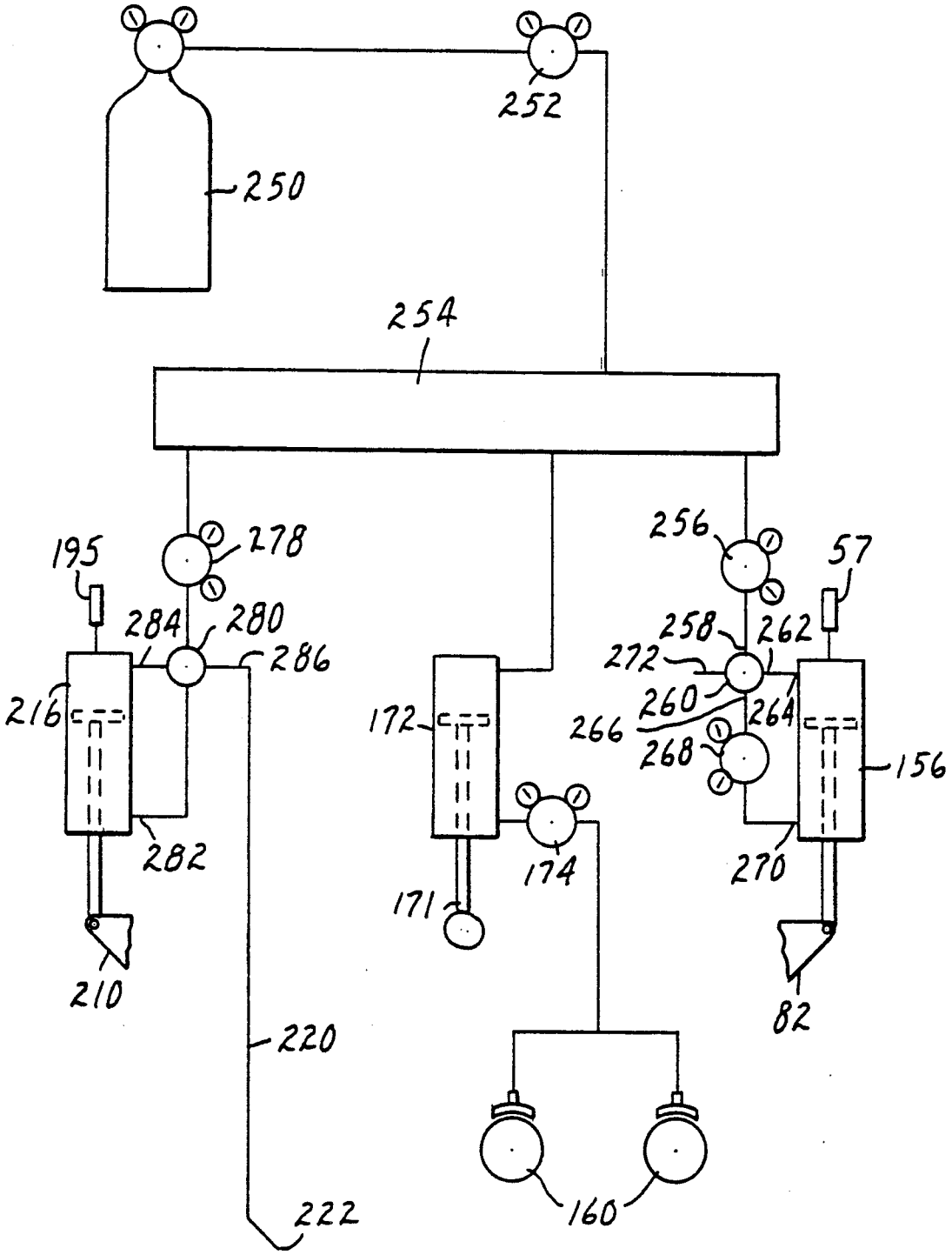
FIG. 12 is a schematic diagram of the pneumatic control system for the left tape.

The piston 156 is actuated to extend or retract by a fluid connection to a pneumatic pressure source. A schematic diagram of the pneumatic controls for the left tape 74 is shown in FIG. 12. The right tape 117 is controlled by substantial duplicate of the pneumatic controls for the left tape 74. Specifically, a compressed gas cylinder 250 is connected to a first pressure regulator 252. Preferably, the compressed gas cylinder 250 contains nitrogen gas. However, other nontoxic gases or gas mixtures such as air may be employed. Alternatively, an air compressor may be employed. The first regulator 252 reduces the high pressure nitrogen (up to about 2500 psi (17.2 MPa)) to a working pressure of about 100 psi (690 KPa). The working gas pressure is connected to a distribution block 254. Preferably, the pressure cylinder 250, first regulator 252, and distribution block 254 are shared by the pneumatic controls for the second tape 117 system.

From the distribution block 254, the working gas pressure is connected to a second adjustable regulator 256 which provides pressure of, for example, about 50 psi (345 KPa) to a first port 258 of a four-way solenoid valve 260. A second port 262 of the four-way solenoid valve 260 is connected to the upper port 264 of the piston 156. Application of pneumatic pressure to the upper port 264 of piston 156 results in extension of the piston 156 and thereby increases the serpentine path length of tape 74.

A third port 266 of the four-way solenoid valve is connected to a third adjustable pressure regulator 268 which in turn is connected to the lower port 270 of the piston 156. Application of pneumatic pressure to the lower port 270 results in retraction of the piston 156 and thereby decreases the serpentine path length. The remaining fourth port 272 of the four-way solenoid valve 260 serves as an exhaust. The second pressure regulator 256 serves to reduce the pressure of the compressed gas to a pressure $P_1$ which is the pressure supplied to the upper (extension actuating) port 264 of piston 156. The third pressure regulator 268 serves to potentially further reduce the pressure of the compressed gas to a pressure $P_2$ which is equal to or less than $P_1$ and which is supplied to the lower (retraction actuating) port 270. Typical pressures $P_2$ are, for example, about 140–210 KPa.

The two functions of the four-way solenoid valve 260 are as follows: In a first mode; the four-way solenoid valve 260 connects the upper (extension actuating) port 264 of piston 156 to compressed gas at pressure $P_1$ and simultaneously connects the lower (retraction actuating) port 270 of piston 156 to the exhaust port 272 of the four-way solenoid valve 260 (and thereby releases any retraction pressure). In a second mode; the four-way solenoid valve 260 connects the lower (retraction actuating) port 270 of piston 156 to compressed gas at pressure $P_2$ and simultaneously connects the upper (extension actuating) port 264 of piston 156 to the exhaust port 270 of the four-way solenoid valve 260 (and thereby releases any extension pressure). A preferred valve is a solenoid pilot valve such as a Skinner V935LEH2100 12 V.D.C. available from the J. E. Braas Company of Minneapolis, Minn.

In summary, the double acting piston 156 provides retraction at a lower force level and extension at a relatively higher force level. Selection of retraction or extension is by means of a solenoid 260. Preferably, the second pressure regulator 256 is adjusted to provide compressed gas at a relatively high pressure $P_1$ to extend the piston 156. Extension of the piston 156, in concert with the force provided by tension spring 150 serves to strongly drive pivotable arm 82 away from stationary arm 80. In contrast, retraction of piston 156 works against or roughly balances the opposite force provided by spring 150. Preferably, the third regulator 268 is adjusted to provide compressed gas (at a relatively low pressure $P_2$) so as to closely balance the force of spring 150.

The ability to individually adjust the two pressures, $P_1$ and $P_2$, supplied to piston 156 allows an operator to adjust and finely tune the device 24 to substantially avoid stretching or breaking of tape 74 during initiation of application and accumulate any excess tape 74 dispensed at the termination of application. Further, the ability to individually adjust the two pressures $P_1$ and $P_2$, allows an operator to adapt the device 24 to a wide variety of road marking tapes and application conditions.

The solenoids are controlled by a timing mechanism previously disclosed in U.S. Pat. No. 4,030,958, which is incorporated by reference herein. The timing mechanism senses travel of the apparatus 20 along the roadway surface 30 through optical detection of rotation of the preliminary pressing roller 108. A preferred digitizer is a Rotopulser brand digitizer such as a type 62 AAEF-0200-A-0-00 available from the Dynapar Corporation of Gurnee, Ill.

Figure 6:
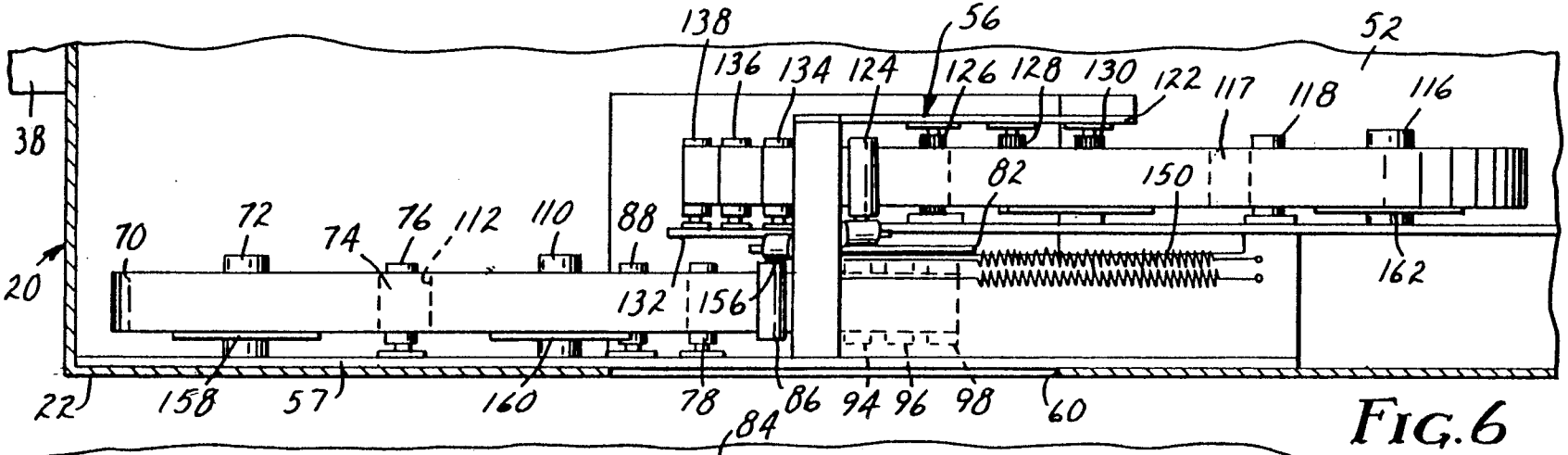
FIG. 6 is a top plan view at 6—6 of FIG. 5.
Figure 7:
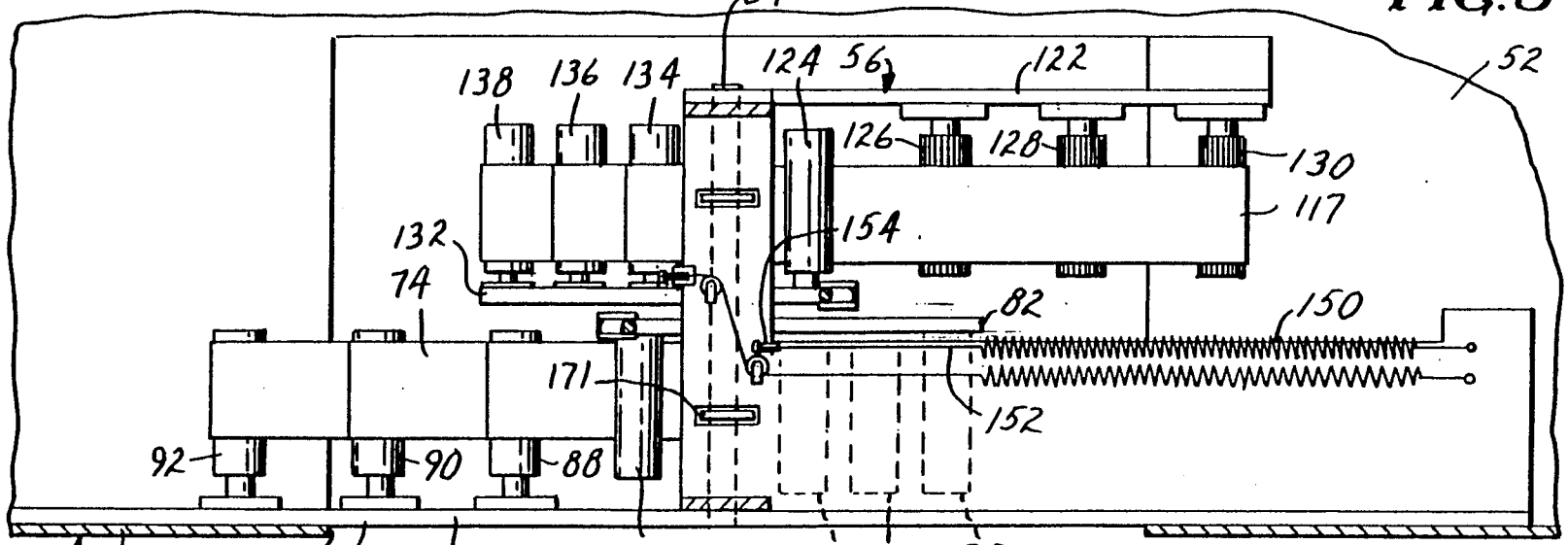
FIG. 7 is a sectional view at 7—7 of FIG. 5.

As shown in FIG. 6, the mandrels 72, 110 and 114 are provided with pneumatically operated disc brakes 158, 160, and 162, respectively. A similar arrangement for mandrel 116 is not shown. The mandrels 72, 110, 114 and 116 each also include three radially spaced teeth (not shown) (which serve to grip the cardboard hub of each tape roll) as well as a detachable quick-release cap for locking the tape roll to the mandrels and transferring any braking force to the roll.

Figure 8:
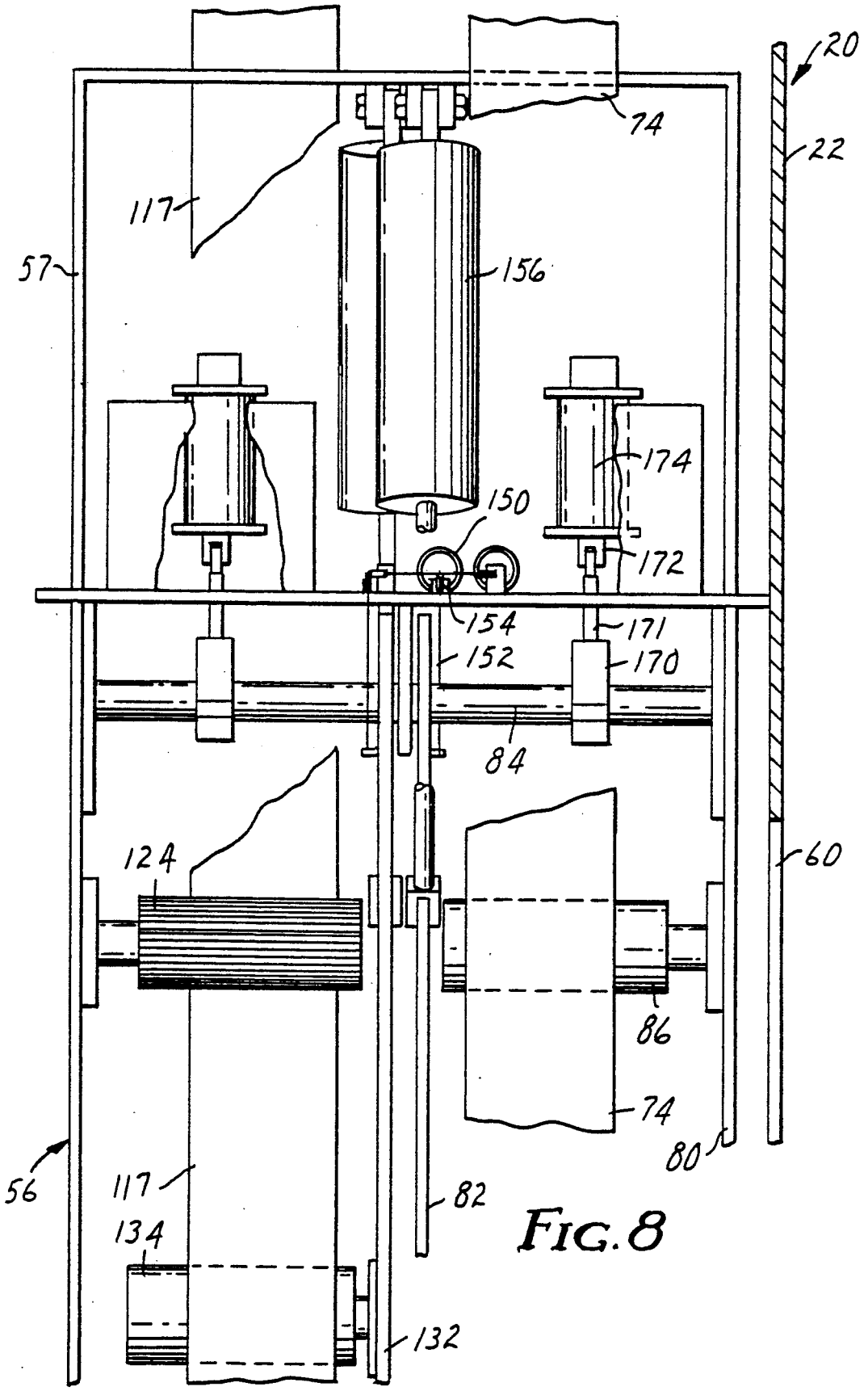
FIG. 8 is a detailed end view of the pivot axis portion of the device, looking toward the rear of the apparatus, showing the pivotable accumulator arms, the cam operated valves and the air cylinders.

As shown in FIG. 8, projecting upward from the pivotable accumulator arm 82 is a cam 170. The cam 170 acts upon a cam follower 171 on a piston 172 of a variable pressure pneumatic regulator 174. The variable pressure pneumatic regulator 174 provides pneumatic pressure to disc brakes 158 and 160 controlling the rotation of the feed mandrels 72 and 110. Specifically, gas from the distribution block 254 of FIG. 12 is also routed to the variable pressure regulator 174. Output gas, at variable pressures from 0–100 psi (690 KPa) is then routed to both disc brakes 158 and 160. Together, the cam 170 and variable pressure regulator 174 function such that when the angle between the pivotable arm 82 and the stationary arm 80 is from preferably about 0° to about 15°, no pneumatic pressure is supplied to the disc brakes 158 and 160, and the mandrels 72 and 110 are free to rotate. A preferred variable regulator 174 is a Command Air brand pneumatic control valve mode F 05118016 available from the Schrader Bellows Company. This particular valve provides high pressure when the piston 172 is in a retracted position and no pressure when the piston 172 is extended.

From preferably about 15° to about 45° of angle between the pivotable arm 82 and the stationary arm 80, the pneumatic pressure to the disc brakes 158 and 160 of the mandrels 72 and 110 is progressively increased and rotation of the mandrels 72 and 110 is progressively inhibited. From preferably about 45° to about 60° of angle between the pivotable arm 82 and the stationary arm 80, maximum braking pressure is applied to the disc brakes 158 and 160 to prevent or nearly prevent rotation of the mandrels 72 and 110.

In this way, overspinning of the tape rolls 70 and 112 is progressively inhibited as the accumulator mechanism 56 reaches its maximum capacity of serpentine path length. Conversely, the tape rolls 70 and 112 are completely freed to rotate and thereby dispense tape as the accumulator pathway is shortened and approaches a shortage of tape for release to the tape deposition mechanism 54.

Figure 9:
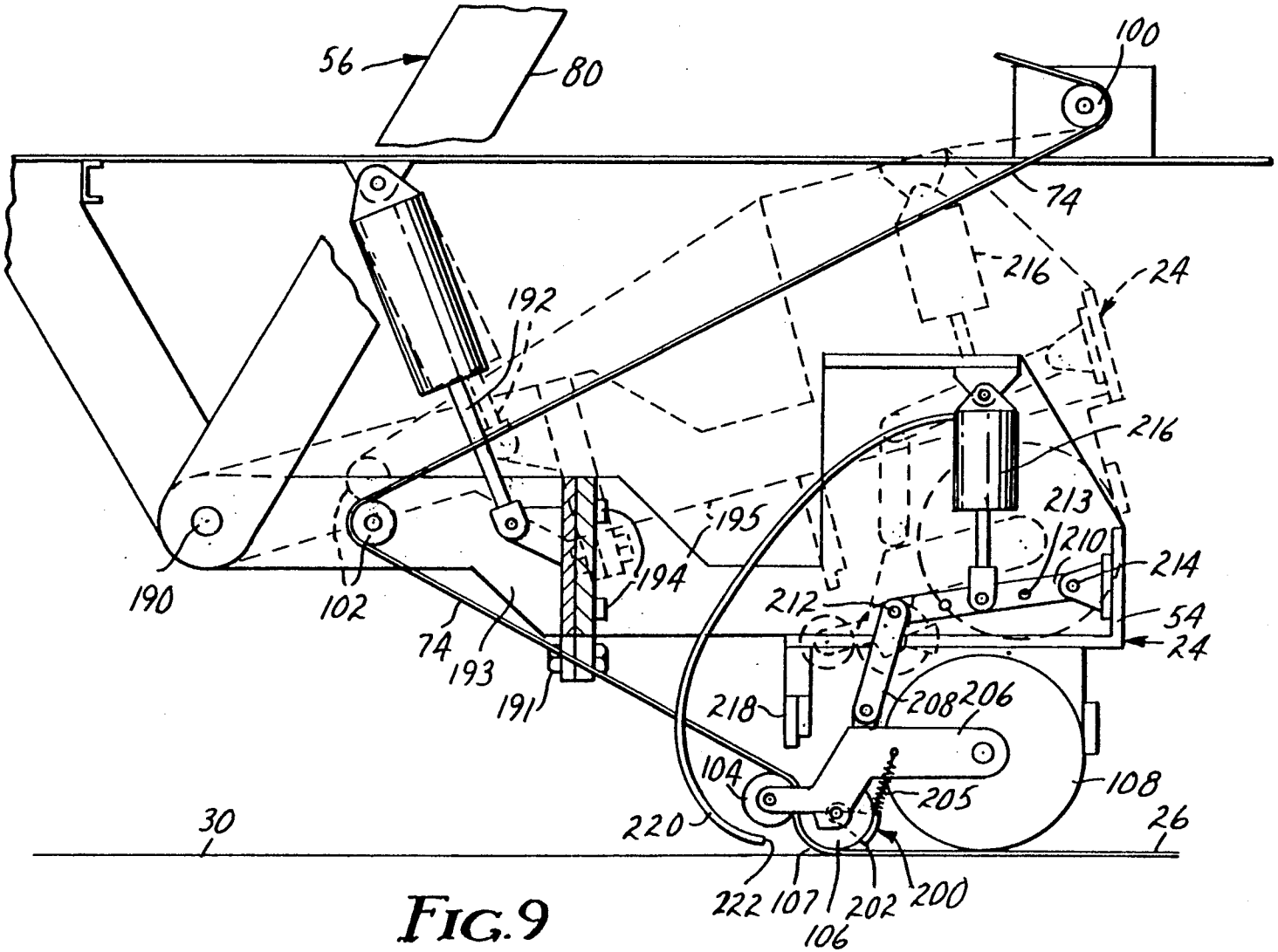
FIG. 9 is a detailed left side elevation view of the tape deposition mechanism with a raised position shown in dotted outline.

The tape deposition mechanism 54 is connected to the frame system 57 at pivot point 190 as shown in FIG. 4 and FIG. 9. A hydraulic ram 192 allows the deposition mechanism 54 to be lifted off the ground. For high-speed transportation, a chain support (not shown) is used to support the tape deposition mechanism 54 thereby relieving the load on the hydraulic ram 192 and avoiding possible damage.

Constant contact of the preliminary pressing roller 108 is essential to the application process since rotation of the preliminary pressing roller 108 provides detection of the distance traveled on the roadway surface 30 to the timing mechanism controlling the various solenoids of the device 24. Additionally, the engagement rollers 106 are parallel to the preliminary pressing rollers 108, and may possibly fail to form an acceptable nip 107 with the roadway surface 30. To allow better contact of the preliminary pressing rollers 108 to the roadway surface 30 during tape application, the deposition mechanism 54 has limited rotation about two separate axes. The first axis corresponds to pivot point 190 and allows for rotational motion about a leading transverse axis 190. Effectively, limited up and down motion is accommodated.

Figure 11:
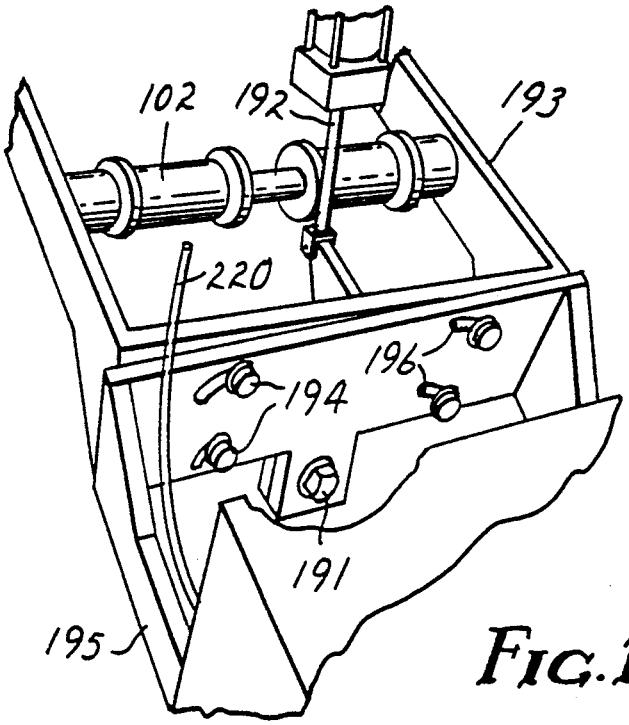
FIG. 11 is a perspective view showing the pivotal axis of the tape deposition mechanism at 11—11 of FIG. 10.

The second axis is a longitudinal axis at a pivot 191 between a forward carriage 193 and a rearward carriage 195 as shown in FIG. 11. Specifically, the forward carriage 193 has pivot (e.g. bolt) 191 projecting longitudinally rearward from its lower rear edge and into a pivot bore in the lower forward edge of the rearward carriage 195. Additionally, the forward carriage 193 also includes bores for four guide bolts 194 projecting longitudinally rearward. The rearward carriage 195 has four arcuate slots 196 to accept guide bolts 194. The specific curved patterns of arcuate slots 196 are circumferential about pivot 191. Together, the longitudinal pivot 191 and arcuate slots 196 enable a limited rotation of the rearward carriage 195 of about ±4° either direction from horizontal.

A tape cutter 200 has a blade 202 which shares a common rotation axis with engagement roller 106. A helical tension spring 205, as shown in FIG. 10, typically holds the tape cutter 200 against a metal strut 204 which is rigidly mounted on the rearward carriage 195.

Figure 10:
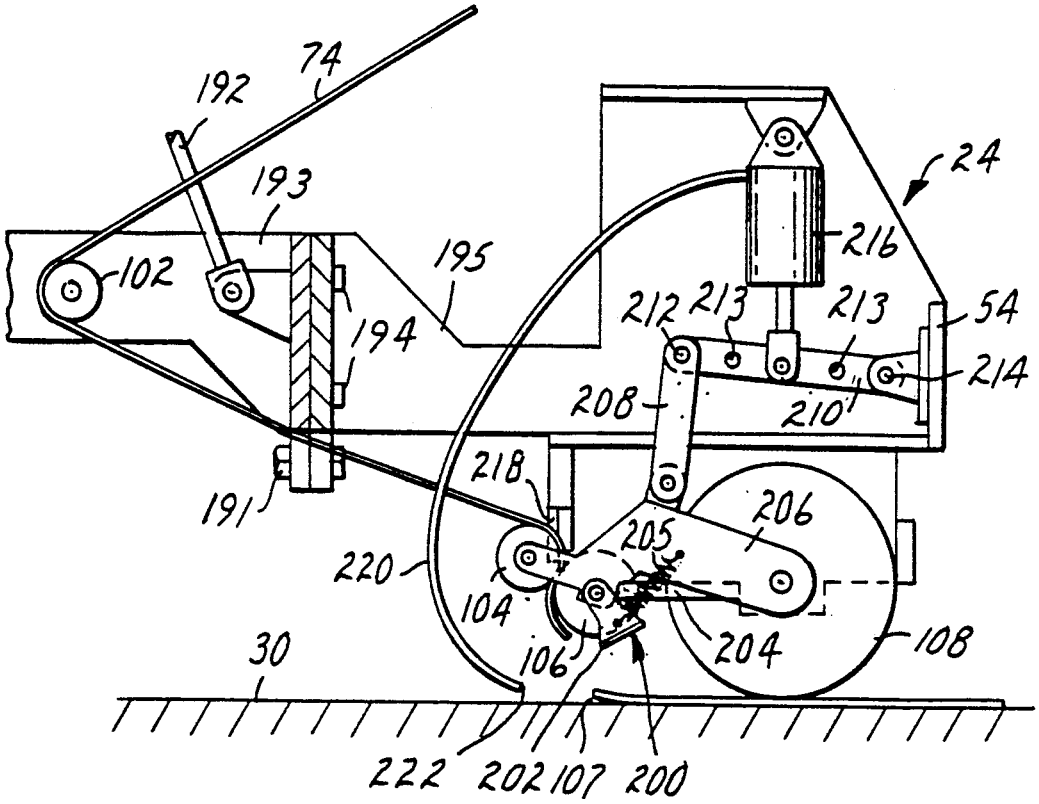
FIG. 10 is a left side elevation view of the tape deposition mechanism during tape cutting.

FIG. 10 shows the disposition of the tape deposition mechanism 54 immediately prior to initiation of tape application. The keeper roller 104 and the engagement roller 106 are carried in a frame 206. The frame 206 also is carried by the axle of the preliminary pressure roller 108 which in turn is mounted on the rear carriage 195. The frame 206 is further connected to a leg 208 which in turn is connected to a beam 210 at pivot 212. The beam 210 is also connected to the rearward carriage 195 at pivot 214. A double acting pneumatic piston 216, connected between the rearward carriage 195 and the beam 210, lifts (in retracted mode) the leg 208 and causes the frame 206 to pivot upward about the axle of the preliminary pressure roller 108. The upward pivoting of the frame 206 forces the keeper roller 104 toward a stop member 218, thereby trapping the tape 74. Preferably, the stop member 218 is formed of hard rubber and is mounted on the underside of rearward carriage 195.

During initiation of tape application, the piston 216 is actuated through a four-way solenoid valve 280, of FIG. 12, to move the beam 210, leg 208, and frame 206 in a downward direction. Specifically, the valve serves to provide two modes of connections: First, the valve connects the retraction port 282 of the piston 216 to the source of pressurized gas from regulator 278 and simultaneously connects the extension port 284 of the piston 216 to an exhaust port 286 of the four-way valve 280. Alternatively, second, the valve 280 connects the extension port 284 of the piston 216 to the source of pressurized gas from regulator 278 and simultaneously connects the retraction port 282 of the piston 216 to the exhaust port 286 of the valve 280. Preferably the gas supply pressure to the valve 280 is moderated by the pressure regulator 278 to pressures from about 40 to about 85 psi (280–590 KPa). The higher pressures are employed for tapes 74 which are more difficult to sever.

The pneumatic piston 216 may be connected to any one of three mounting holes 213 which have been drilled through the beam 210 to provide faster or slower cutter speeds, depending on the type of tape which is to be applied.

When the piston 216 is actuated to extend, the frame 206 moves rapidly and forcefully from the position shown in FIG. 10 to the position shown in FIG. 9, thereby pressing the leading edge of the tape 74 at the nip 107 into engagement against the roadway surface 30. After the tape 74 has been applied to the roadway surface 30, it is first preliminarily pressed down by roller 108, then pressed or tamped upon by the rear wheel 34 of the vehicle 22 to more firmly secure the tape to the roadway surface.

After a stripe 26 of desired length of tape 74 has been applied to the roadway surface, the solenoid valve 280 is operated to supply pressure to retract the pneumatic piston 216, and thereby to pivotably raise the frame 206 to the disposition shown in FIG. 10.

During upward movement of the frame 206, the back side of cutter 200 contacts the strut 204 causing the cutter 200 to pivot. The strut 204 initially contacts the cutter 200 well away from the pivot axis of the cutter 200 but the contact between the strut 204 and the cutter 200 shifts progressively nearer to the pivot axis. Because the motion of the frame 206 is rapid and forceful, the cutter 200 is progressively accelerated, gains momentum, and continues to pivot about the axis when the keeper roller 104 traps the tape 74 against the hard rubber stop 218. This motion continues until cutting edge 202 (preferably a serrated cutting edge) contacts and severs the web of tape 74 extending between the roadway surface 30 and the engagement roller 106. The tape 74 is held taut between the engagement roller 106 and the preliminary pressure roller 108 during the tape cutting operation. In a preferred embodiment, the hard rubber stop 218 is connected to the rearward carriage 195 and acts as a shock absorber to cushion the impact of the engagement roller 106 and the keeper roller 104 with the stop 218.

To assure the end of the tape 74 threads under the engagement roller 106 and into the nip 107 during initiation of tape application between applications, the tape deposition mechanism 54 is further provided with a copper tube 220. The tube 220 is connected to the exhaust port of four-way valve 280 associated with the pneumatic piston 216 at a first end and is positioned so that its second end 222 is directed toward the engagement roller 106. The copper tube 220 provides an appropriately timed surge of pressurized gas from the tube end 222 against the end of tape 74 to direct the end of the tape 74 into the nip 107 being formed. The useful pneumatic surge of pressurized gas provided to the tube 220 is from the exhaust of the pneumatic piston 216 coinciding with a drop of the frame 206 to the ground-engaging position from which the tape 74 will be deposited. The surge of pressurized gas serves to move the end of tape 74 under the engagement roller 106 immediately prior to formation of the nip 107 and assures that the tape 74 will effectively be oriented for engagement and subsequent pressing by wheel 34. The surge is efficiently provided at the proper timing in the application sequence and is a second use of the pressurized gas which previously raised the frame 206.

Prior to the initiation of application of tape 74 in the manner described, the accumulator pivotable arm 82 is arranged such that it forms an angle of about 60° with respect to the stationary arm 80. The pivotable arm 82 is held in this extended position partially by the tension spring 150, shown in FIG. 4. Additional force is applied to urge the pivotable arm 82 to this position by the piston 156.

As previously explained the piston 156 is a two-way piston, that is, it can be actuated to retract or extend by the application of pressure to alternative ports of its cylinder, and thereby operated to either push or pull. At the initiation of a tape application event, the retraction port 270 of the piston 156 receives pneumatic pressure P2 from the third regulator 268. The application of pneumatic pressure to retract the piston 156 slightly relaxes or over balances the tension from spring 150 on the accumulator pivotable arm 82.

Preferably, the balancing of forces at this time is such that manual force will rotate the accumulator pivotable arm 82 from the extended (60°) position toward the stationary arm 80 to release tape 74 for application. The balancing and relaxation of pressure on pivotable arm 82 eases movement of tape 74 when the engagement roller 106 is subsequently pressed toward roadway surface 30 to form nip 107. This, in turn, engages the tape 74 to the roadway surface 30. Engagement of tape 74 and roadway surface 30 at that time results in tension being suddenly and strongly applied on the tape 74.

As application of tape 74 continues, the combination of the force being applied on the tape as it is drawn out into the roadway surface 30 and the inertia in the mandrel 72 and tape roll 70 causes the accumulator pivotable arm 82 to move toward the stationary arm 80 (i.e. toward the empty (0°) position), thereby shortening the serpentine path length. As tape application continues, tension gradually increases at the roll of tape 70 which, in turn, begins to rotate, dispensing tape 74 rapidly through the accumulator 56 for deposition onto the roadway surface 30.

At termination of deposition, the tape 74 is trapped and cut in the deposition mechanism 54. The pneumatic pressure to the double acting piston 156 is reversed (i.e. pressured gas is applied at port 264), forcing the pivotable arm 82 away from the stationary arm 80. As the pivotable arm 82 swings rearward, the serpentine path length increases and the cam 170 causes the disc brakes 158 and 160 to slow and stop the rotation of mandrel 72 and slow and stop dispensing of tape 74.

Various types of road marking tapes are available, and these may be applied using the method and apparatus of the present invention. In a preferred method, the tape 74 carries a pressure-sensitive adhesive, or an adhesive may have been applied to the roadway by other means, so that the tape 74 adheres to the roadway surface 30. When the tape 74 carries a pressure-sensitive adhesive on one side, the rollers of the device described above which contact the adhesive side of the tape 74 are preferably knurled to reduce adhesion of the tape 74 to these rollers. Specifically, for adhesive tapes rolled with the adhesive side directed toward the center of the roll 72, rollers 76, 78, 94, 96, 98, 100, and 104 should be knurled. The rollers contacting the top side of tape 74 (i.e. side intended to face upward when applied to the roadway) should preferably have a smooth surface.

Another feature of the present invention is that the apparatus 20 can be stocked with large supplies of rolls of tapes to be applied to the roadway surface 30. Using the dual mandrel system 58 described above, new rolls of tapes can be loaded into the second mandrel 110 while a first roll 70 is being dispensed from the first mandrel 72 and applied to the roadway surface 30. Just before the first roll 70 of tape runs out, an operator can prepare to splice the leading edge of the second roll of tape to the trailing edge of the first tape. The splicing operation can be performed with a brief stop of 5 seconds or less. After the tape ends have been spliced together (e.g. with double sided adhesive tape, preferably including a nylon web), forward progress of the apparatus 20 is resumed and the tape 74 is then dispensed from the second mandrel 110. The operator can subsequently replace the empty reel of the first mandrel 72 with a full roll of tape. The roll change and splicing steps can be repeated until the supply of tape aboard the vehicle 22 is depleted or until the tape application operation is completed.

Because the present invention is a single vehicle (preferably enclosed) rather than a trailer, it provides added safety to the tape application operation. Specifically, the apparatus 20 eliminates the need for a crew member to return to a trailer by walking on the roadway at each roll change. In other words, it is an advantageous safety feature of the present invention that the entire tape application device 24 can be contained within an enclosed vehicle 22 so that the operator can perform all of the described steps without exiting the vehicle 22 and thereby avoiding exposure to potentially hazardous traffic.

Having fully described the preferred embodiments of the invention, it should be understood that numerous alternatives and equivalents which do not depart from the present invention will be apparent to those skilled in the art, given the teaching herein, and are intended to be included within the scope of the present invention. The invention is not to be unduly limited by the aforementioned descriptions.

What is claimed is:

1. An apparatus for applying pavement-making tape to a roadway surface comprising:

a self-propelled steerable vehicle having a rear wheel mounted to one side of the vehicle for supporting the vehicle;

a first device carried by the vehicle, the first device including:

a plurality of feed mandrels mounted on the device for rotatably supporting and dispensing rolls of tape;

means for accumulating a variable length of tape from one of the mandrels of the plurality; and a tape deposition mechanism situated adjacent the roadway surface preceding the rear wheel of the vehicle and aligned with said rear wheel so that the pavement marking tape is driven against the roadway by the rear wheel during forward motion of the vehicle.

2. An apparatus for applying pavement-marking tape to a roadway surface comprising:

a self-propelled steerable vehicle having a rear wheel;

a first device carried by the vehicle, the first device including:

a plurality of feed mandrels mounted on the device for rotatably supporting and dispensing rolls of tape;

means for accumulating a variable length of tape from one of the mandrels of the plurality, said means comprising a set of guides defining a variable length pathway for tape;

a first accumulator roller mounted on a first guide of the set;

a second accumulator roller mounted on a second guide of the set in spacial relationship with and movable relative to the first accumulator roller to define at least a portion of the variable length pathway; and mean for moving the second guide to alter the length of the pathway defined by the guides; and a tape deposition mechanism situated adjacent the roadway surface preceding the rear wheel of the vehicle.

3. The apparatus of claim 2 and further comprising:

means for releasing a variable length of tape from the means for accumulating.

4. The apparatus of claim 3 wherein the means for releasing a variable length of tape includes a cutting means the speed of which is variable.

5. The apparatus according to claim 2 wherein each of the mandrels of the plurality is provided with pneumatically operated brakes for controlling rotation of the tape rolls.

6. The apparatus according to claim 2 wherein the deposition mechanism comprises a guide roller forming a nip with the roadway surface.

7. The apparatus of claim 6 wherein the deposition mechanism further includes pneumatic blowing means to urge a free end of a tape into the nip.

8. The apparatus of claim 6 wherein the deposition mechanism is movable about a first generally longitudinally arranged axis and a second transversely arranged axis to enable the guide roller to track the roadway surface.

9. The apparatus of claim 2 wherein the means for moving the guide is a pneumatic piston.

10. The apparatus of claim 6 wherein the self-propelled steerable vehicle includes a rear dual wheel and further comprising a second device similar to said first device having a nip aligned in front of the rear dual wheel.

11. An apparatus for applying pavement-marking tape to a roadway surface comprising:

a self-propelled steerable vehicle having a rear wheel supporting the vehicle;

a first device carried by the vehicle, the first device including:

a plurality of feed mandrels mounted on the device for rotatably supporting and dispensing rolls of tape each of said mandrels having pneumatically operated disc brakes, for controlling rotation of tape rolls;

means for accumulating a variable length of tape from one of the mandrels of the plurality;

controls for the disc brakes comprising a cam driven variable pressure regulator the output of which depends upon the length of tape in the means for accumulating; and a tape deposition mechanism situated adjacent the roadway surface preceding the rear wheel of the vehicle and aligned with said rear wheel so that the pavement marking tape is driven against the roadway by the rear wheel during forward motion of the vehicle.

12. An improved method for applying pavement-marking tape to a roadway surface comprising the steps:

providing a self-propelled vehicle having a wheel supporting the vehicle on the roadway surface and carrying a first device comprising a tape deposition mechanism situated adjacent a portion of the roadway surface preceding the wheel; and depositing tape upon the roadway surface; wherein the improvement comprises tamping the deposited tape with the wheel of the vehicle mounted to one side thereof.

* * * * *